US006227360B1

(12) United States Patent
Kessler

(10) Patent No.: US 6,227,360 B1
(45) Date of Patent: May 8, 2001

(54) PACKAGE

(75) Inventor: John R. Kessler, Dayton, OH (US)

(73) Assignee: Monarch Marking Systems, Inc., Dayton, OH (US)

( * ) Notice: Subject to any disclaimer, the term of this patent is extended or adjusted under 35 U.S.C. 154(b) by 444 days.

(21) Appl. No.: 08/686,883

(22) Filed: Jul. 26, 1996

(51) Int. Cl.[7] ..... B65D 69/00

(52) U.S. Cl. ..... 206/226; 206/205; 206/394; 206/410; 206/497

(58) Field of Search ..... 206/226, 389, 206/225, 393, 394, 397, 410, 413, 497, 471

(56) References Cited

U.S. PATENT DOCUMENTS

| | | | | |
|---|---|---|---|---|
| 753,543 | * | 3/1904 | Case | 206/226 |
| 1,214,750 | * | 2/1917 | Burtis | 206/226 |
| 1,365,403 | * | 1/1921 | Holway | 206/226 |
| 1,897,334 | * | 2/1933 | Richer | 206/226 |
| 2,458,898 | * | 1/1949 | Addario | 206/394 |
| 2,537,184 | * | 1/1951 | Dunn | 206/226 |
| 2,628,713 | * | 2/1953 | Diederich | 206/226 |
| 2,678,129 | * | 5/1954 | Spector | 206/226 |
| 3,407,781 | * | 10/1968 | Ardire et al. | 206/389 |
| 3,770,118 | * | 11/1973 | Jones | 206/226 |
| 5,377,831 | | 1/1995 | Crooks . | |

* cited by examiner

*Primary Examiner*—Luan K. Bui
(74) *Attorney, Agent, or Firm*—Joseph J. Grass

(57) ABSTRACT

There is disclosed a package containing a series of side-by-side label rolls and an ink roll package positioned in a tubular opening in the label rolls and having a flange against the side of the endmost roll. The flange provides a stop to limit migration or insertion of the ink roll package into the opening. The flange provides a surface to which a cover sheet or label can be releasably attached. The cover sheet can carry a substantial amount of information and is peelable to release the ink rolls.

11 Claims, 2 Drawing Sheets

PACKAGE

BACKGROUND OF THE INVENTION

1. Field of the Invention

This invention relates to the field of label roll packages and ink roller packages.

2. Brief Description of the Prior Art

It is known in the art to have a series of label rolls packaged in side-by-side relationship. A series of label rolls can be shrink wrapped or simply placed in a box. Each label roll is comprised of a web of pressure sensitive labels. Each label roll has a central opening. The central opening can be defined either by the inner wrap or convolution of the label web or by a core. The central openings of the label rolls are aligned to provide a tubular opening.

It is known to provide an ink roller in a partially transparent blister package, as disclosed with reference to FIGS. 8 and 9. The blister package can be sized to be inserted into and frictionally held inside the tubular opening, but it sometimes happens that the ink roller blister package is far enough into the tubular opening to be difficult to remove without separating the label rolls or using a tool. The blister package construction of FIGS. 8 and 9 suffers the further disadvantage that the cover sheet is too small to be printed with very much data such as the part number, color information, the date of manufacture, the patent notice, the trade name of the manufacture, and other data. In addition, the ink roller can bleed ink onto the somewhat flexible paper cover of the blister package.

Alternatively, the ink roller can be packaged in a flexible, transparent plastic bag which is inserted into the tubular opening as disclosed in U.S. Pat. No. 3,987,897 to Smith. As with the blister package, the bag may move to a position too far into the tubular opening. The plastic bag approach suffers the disadvantage that the inside of the bag becomes coated with ink from the ink roller and this increases the chance that when the bag is opened to free the ink roller, the user will get ink on his/her hands. In addition to wasting ink, the bag gives an unsightly appearance and ink on the inside surface of the bag may obscure readability of printed data on the outside of the bag.

It is also known to provide an ink roller in a transparent, rigid container having a tubular portion integrally joined to an end portion and having a rigid removable plug or cap for closing off the open end. An unoriented ink roller extends axially of the tubular portion. The container is freely received in the tubular opening within the label rolls. Ink rollers with extensions or handles are known in the art, as shown for example in U.S. Pat. No. 3,957,562 to P. Hamisch, Jr. A blister package is disclosed in U.S. Pat. No. 4,875,620 to W. Lane, Sr.

SUMMARY OF THE INVENTION

This invention relates to an improved package for label rolls and an ink roller. According to one specific embodiment of the invention, a series of side-by-side label rolls and an ink roll package are packaged into a unit for shipment to the customer. Each label roll includes a web of pressure sensitive labels. Each label roll has a central opening. The central openings of the label rolls are generally aligned to provide a tubular opening. An ink roller package including a closed container is received in the tubular opening. The container has a flange or flange portion adjacent and parallel to a side of one of the label rolls, and there is an ink roller in the container. It is preferred that the ink roller package include a tubular portion joined to the flange and that the tubular portion is frictionally releasably held in the opening. This frictional holding facilitates the further packaging of the label rolls as for example during boxing or shrink wrapping of the label rolls together with the ink roller package. The flange is a stop which prevents the ink roller package from moving into a relatively inaccessible position in the tubular opening of the label rolls. It is also preferred to have a cover sheet across the open flanged end of the ink roller container which not only closes off the open end but which can carry a substantial amount of important printed data. The ink roller is oriented in the container so that when the cover sheet is removed, the handle of the ink roller is readily accessible at the open end of the container.

DETAILED DESCRIPTION OF THE PREFERRED EMBODIMENTS

Figure 1:
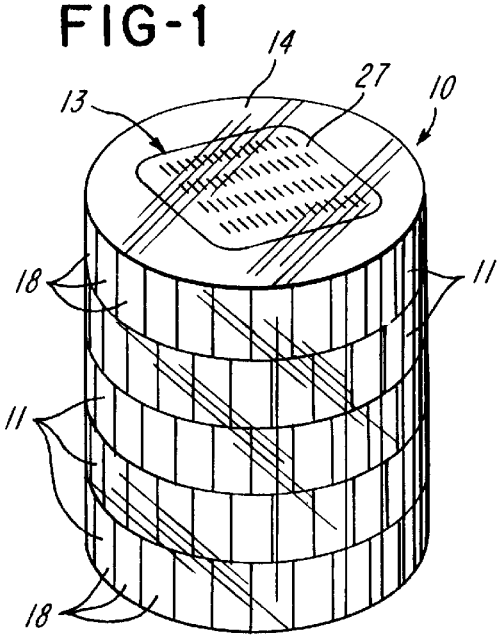
FIG. 1 is a perspective view of a package containing a series of side-by-side label rolls and an ink roller package.

With reference to FIG. 1, there is shown a package generally indicated at 10 including a series of side-by-side label rolls 11 and an ink roller package generally indicated at 13. The package 10 can be held together as a unit by a shrink wrap 14 which essentially envelopes the label rolls 11 and the ink roller package 13.

Figure 2:
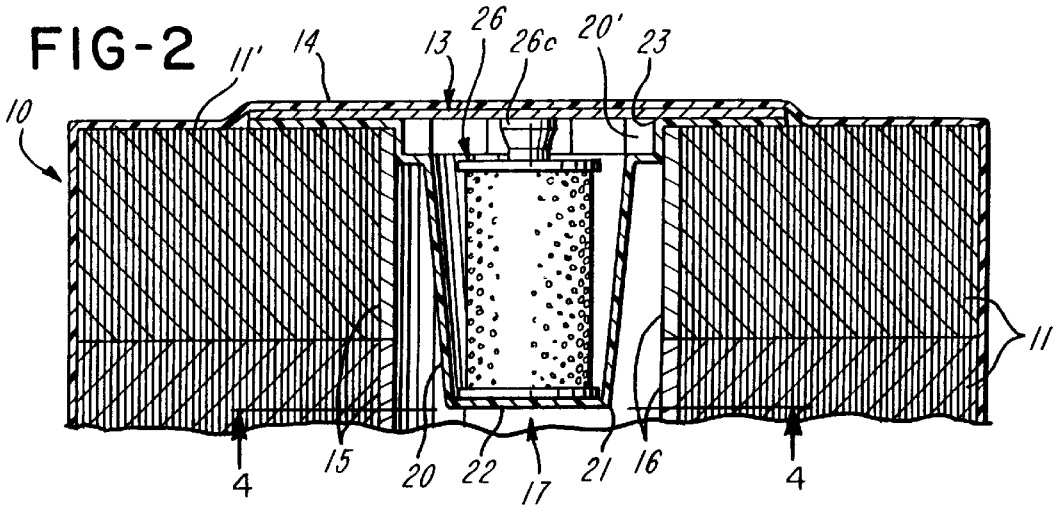
FIG. 2 is an enlarged, fragmentary sectional view of the package.
Figure 4:
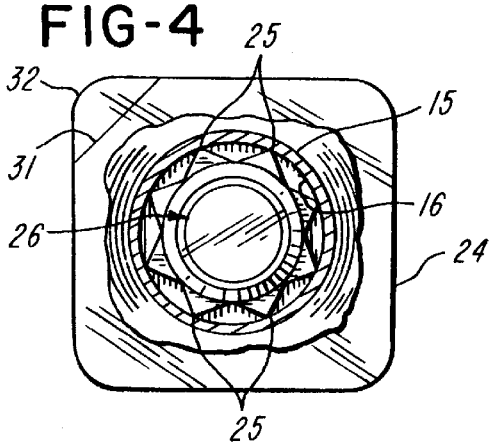
FIG. 4 is a partly broken away view taken along line 4—4 of FIG. 2.
Figure 5:
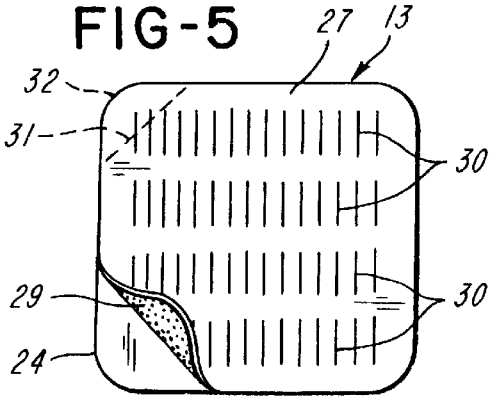
FIG. 5 is a top plan view of the ink roller package.

Each label roll 11 has an annular or tubular central core 15 which defines a central opening 16. The central openings 16 are generally aligned and define a tubular opening generally indicated at 17 within the series of label rolls 11. Each label roll 11 is comprised of a web of pressure sensitive labels 18 which has been wound onto the respective core 15. Further examples of such pressure sensitive labels can be found in U.S. Pat. No. 3,783,083. The labels can also be provided in linerless label webs, if desired. As shown in FIG. 2, the label rolls 11 are in side-by-side abutting relationship.

Figure 3:
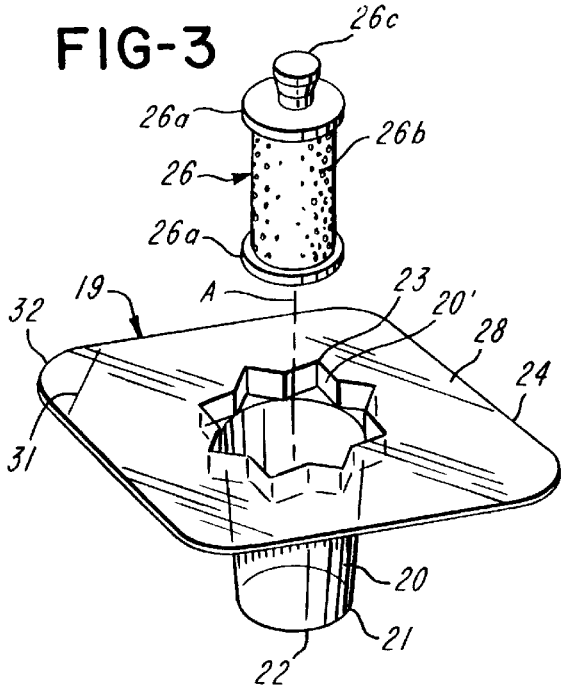
FIG. 3 is a perspective view of the ink roller and its container.

With reference to FIG. 3, there is shown an ink roller container generally indicated at 19 of the package 13. The container 19 has an elongate, longitudinally extending, generally tubular portion or ink roller receiving portion 20 with a slight conical taper, an end 21 closed off by an end closure portion 22, an open end 23, and a flange or flange portion 24. The flange portion 24 extends transversely outwardly from the open end. The flange portion 24 extends perpendicular to the axis A of the tubular portion. As shown in FIG. 2, the flange portion 24 is adjacent, and more specifically, one side of the flange portion 24 is in contact with outer side 11' of the endmost label roll 11. In turn, the shrink wrap 14 contacts the outer side of the ink roller package 13. As shown, the flange portion 24 acts as a stop to assure that the ink roll package 13 does not move or migrate too far into the tubular opening 17. Thus, the ink roll package 13 is always accessible from one side of the package 10.

As shown, the generally tubular portion 20 has a series of ridges 25 adjacent the open end 23. The ridges 25 make frictional contact with the central opening 16 at the inside of the core 15 to frictionally hold the container 19 in position until the packaging operation is complete. The container 19 is preferably comprised of a vacuum formed, semi-rigid, transparent plastics material which serves as a vapor barrier and which can resiliently yield slightly upon insertion into the endmost core 15. The wall thickness of the container 19 is essentially constant throughout the container 19 because the container 19 is formed from a constant thickness sheet or web of formable plastics material. The ridges 25 are part of an enlarged portion 20' and preferably extend in the axial direction of the tubular portion 20, are relatively short in length and preferably contact only the endmost label roll 11. The container 19 can, however, extend into the opening 17 in more than one label roll 11, as shown.

FIG. 3 shows that an ink roller generally indicated at 26 is to be received in the tubular portion 20. The ink roller 26 is shown to have a pair of bearing flanges or rolls 26*a*, a porous sleeve 26*b* and an annular handle 26*c*. The ink roller 26 is oriented so that its handle 26*c* is adjacent the open end 23. The assembled condition of the ink roller package 13 is also shown in FIG. 2. The porous sleeve 26*b* does not contact the inside of the tubular portion 20. When the ink roller 26 is in the container 19, a cover sheet or label 27 is applied to the outer surface 28 of the flange portion 24. The cover sheet 27 is preferably composed of a plastics material and as such serves as a vapor barrier. The underside of the cover sheet 27 has a coating of an adhesive 29 which releasably adheres the cover sheet 27 to the flange 24. The cover sheet 27 is preferably peelable from the flange 24. It is preferred that the adhesive 29 be of the heat-activated dry-tack type.

An advantage of the improved ink roller package is to have substantial area available for printed data 30 such as the part number, an indication of color, the manufacturer's data code, the manufacturer's name and/or logo, patent numbers, trademarks and other information. The printed data is shown to be on the outer surface of the cover sheet 27.

One corner of the flange portion 24 is heavily scored or completely severed as indicated at 31 to provide a tab or handle 32. By bending the scored tab 32, the tab 32 breaks off. The cover sheet 27 remains secured to the tab 32. The cover sheet 27 can be readily peeled from the flange 24 using the tab 32.

If desired, the shrink wrap 14 can be omitted and the label webs 11 can simply be placed in a box. The ink roller package 13 can be inserted to the position shown in FIG. 2 either before or after the series of label rolls is placed in the box.

By way of example, not limitation, the core 15 has an inside diameter or central opening 16 of about 1 inch. The overall length of the ink roller package 13 from the end closure portion 22 to the cover sheet 27 is about 1.125 inches. The flange 24 and the cover sheet 27 are about 1.75 inches square. The outside diameter of the tubular portion 20 at the ridges 25 is preferably about 1.03 inch. The axial extent of the ridges 25 is about 0.35 inch. The flange 24 is preferably substantially larger than the tubular opening 17. For example, the cover 27 extends beyond the tubular opening 17 by at least 0.2 inch.

Figure 6:
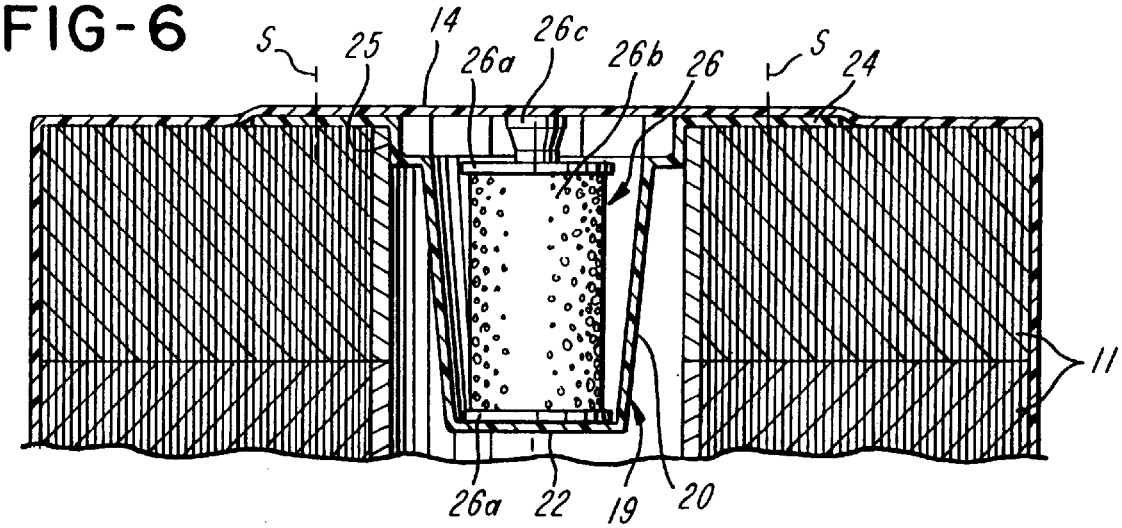
FIG. 6 is a sectional view showing an alternative embodiment of the package of the invention.
Figure 7:
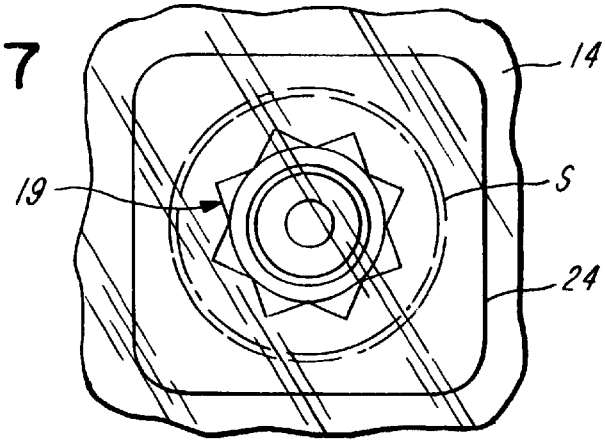
FIG. 7 is a fragmentary top plan view of the package illustrated in FIG. 6.

The embodiment of FIGS. 6 and 7 is the same as the embodiment of FIGS. 1 through 5, except as follows. Where components are the same, the same reference characters are used. As shown, the shrink wrap 14 itself serves the dual function of holding the rolls 11 and the ink roller container 19 in tact and clean until ready to be used, and of closing or sealing off the container 19 and the ink roller 26 which it houses. The shrink wrap 14 is adhesively adhered or heat sealed directly to the flange 24 of the container 19 at a seal line S. The ink roller 26 is thus protected from the ambient air by a vapor barrier provided by the container 19 and the shrink wrap 14. The shrink wrap 14 acts as the cover sheet for the end opening of the container 19.

Figure 8:
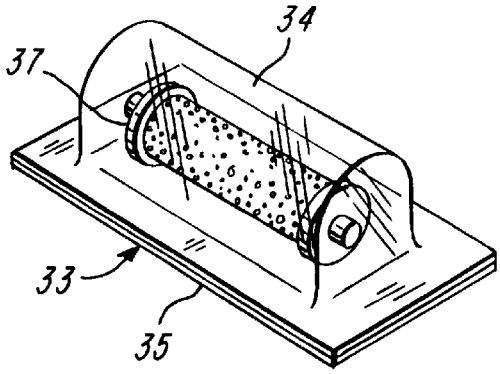
(PRIOR ART) FIG-8
FIG. 8 is a perspective view of a prior art ink roller package.
Figure 9:
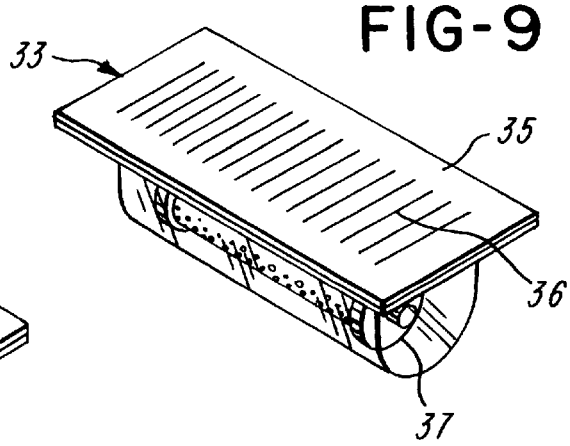
(PRIOR ART) FIG-9
FIG. 9 is another perspective view of the prior art ink roller package shown in FIG. 8.

A prior art ink roller package 33 is shown in FIGS. 8 and 9. A formed transparent plastics container 34 is closed off by a cover sheet or label 35. The package 33 is designed to fit within the tubular opening in a series of label rolls. FIG. 9 shows that if the package 33 is to fit into the tubular opening, the cover sheet 35 has very little room for printed data 36. As shown especially well in FIG. 8, the ink roller package includes an ink roller 37.

Other embodiments and modifications of the invention will suggest themselves and modifications of the invention will suggest themselves to those skilled in the art, and all such of these as come within the spirit of this invention are included within its scope as best defined by the appended claims.

What is claimed is:

1. A package, comprising: a series of side-by-side label rolls, each label roll including a web of pressure sensitive labels, each label roll having a central opening, the central openings being generally aligned to provide a tubular opening, an open-ended container received in the tubular opening, the container having a flange adjacent the outside of the endmost label roll of the series of label rolls, an ink roller in the container, and shrink wrap enveloping the label rolls and sealed to the flange to thereby enclose the ink roller in the container.

2. A package, comprising: an ink roller container including an elongate portion having a closed end and an open end, a removable cover for closing off the open end, an ink roller in the elongate portion, the ink roller having opposite ends, a handle at one end of the ink roller and the other end being free of any handle, and wherein the handle is oriented at the open end so that the handle is accessible when the cover is removed.

3. A package as defined in claim 2, wherein the cover comprises a cover sheet.

4. A package as defined in claim 2, wherein the container includes a flange at the open end, and the cover includes a cover sheet adhered to the flange.

5. A package, comprising: at least one label roll having a web of pressure sensitive labels, the label roll having a central opening, an ink roller container including an elongate portion having a closed end and an open end, the elongate portion being received in the central opening, a removable cover for closing off the open end, an ink roller in the elongate portion, the ink roller having opposite ends, a handle at one end of the ink roller and the other end being free of any handle, and wherein the handle is oriented at the open end so that the handle is accessible when the cover is removed.

6. A package, comprising: a series of side-by-side label rolls, each label roll having a web of pressure sensitive labels, each label roll having a central opening, the central openings being generally aligned to provide a tubular opening, an ink roller container including an elongate portion having a closed end and an open end, the elongate portion being received in the tubular opening, a removable cover for closing off the open end, an ink roller in the elongate portion, the ink roller having opposite ends, a handle on one end of the ink roller and the other end being free of any handle, wherein the handle is oriented at the open end so that the handle is accessible when the cover is removed, and the container having a stop to prevent the container from moving too far into the tubular opening.

7. A package, comprising: a series of side-by-side label rolls, each label roll having a web of pressure sensitive labels, each label roll having a central opening, the central openings being generally aligned to provide a tubular opening, an ink roller container including an elongate portion having a closed first end and an open second end, a flange joined to the second end and extending outwardly from the open end, the flange preventing the container from moving to a location in the tubular opening from which the ink roller container would difficult to remove, the elongate portion being received in the tubular opening, a removable cover for closing off the open end, an ink roller in the elongate portion, the ink roller having opposite ends, a handle at one end of the ink roller and the other end being free of any handle, and wherein the handle is oriented at the open end so that the handle is accessible when the cover is removed.

8. A package, comprising: at least one label roll having a web of pressure sensitive labels, the label roll having an axial central opening, an ink roller container having an axially extending elongate portion, an ink roller received axially in the central opening, the elongate portion having an enlarged portion frictionally releasably held in the central opening, and wherein the axial extent of the enlarged portion is substantially less than the axial extent of the elongate portion.

9. A package, comprising: at least one label roll having a web of pressure sensitive labels, the label roll having an axially extending central opening, an ink roller container having an axially extending elongate portion, the elongate portion having an enlarged portion frictionally releasably held in the central opening, the container having an open end at the enlarged portion, a peelable cover closing off the open end, and an ink roller axially received in the central opening.

10. A package, comprising: at least one label roll having a web of pressure sensitive labels, the label roll having a central opening, an ink roller container having a generally tubular portion extending in an axial direction, the tubular portion being frictionally releasably held in the central opening, an ink roller received axially in the tubular portion, wherein the ink roller has a pair of spaced flanges and a porous sleeve between the flanges, wherein the transverse extent of the flanges is greater than the transverse extent of the porous sleeve, wherein the porous sleeve does not contact the inside of the tubular portion, wherein the tubular portion has a closed end and an open end, a cover closing off the open end, and wherein one end of the ink roller contacts the closed end and the other end of the ink roller contacts the cover.

11. A package, comprising: an ink roller container having a tubular portion extending in an axial direction, an axially extending ink roller, wherein the ink roller has a pair of spaced flanges and a porous sleeve between the flanges, wherein the transverse extent of the flanges is greater than the transverse extent of the porous sleeve, wherein the porous sleeve does not contact the inside of the tubular portion, wherein the tubular portion has a closed end and an open end, a peelable cover closing off the open end, and wherein one end of the ink roller contacts the closed end and the other end of the ink roller contacts the cover.

* * * * *

UNITED STATES PATENT AND TRADEMARK OFFICE

CERTIFICATE OF CORRECTION

PATENT NO. : 6,227,360 B1
DATED : May 8, 2001
INVENTOR(S) : John R. Kessler

It is certified that error appears in the above-identified patent and that said Letters Patent is hereby corrected as shown below:

Title page,
References omitted, please insert

| | | |
|---|---|---|
| -- 3,783,083 | 12/71 | Jenkins |
| 3,957,562 | 05/76 | Hamisch, Jr. |
| 3,987,897 | 10/76 | Smith |
| 4,875,620 | 10/89 | Lane, Sr. -- |

Column 5,
Line 21, after "would" insert -- be --

Signed and Sealed this

Fourteenth Day of May, 2002

*Attest:*

*Attesting Officer*

JAMES E. ROGAN
*Director of the United States Patent and Trademark Office*